US006212496B1

(12) United States Patent
Campbell et al.

(10) Patent No.: US 6,212,496 B1
(45) Date of Patent: Apr. 3, 2001

(54) CUSTOMIZING AUDIO OUTPUT TO A USER'S HEARING IN A DIGITAL TELEPHONE

(75) Inventors: Lowell Campbell, Carlsbad; Daniel Robertson, Encinitas, both of CA (US)

(73) Assignee: Denso Corporation, Ltd. (JP)

( * ) Notice: Subject to any disclaimer, the term of this patent is extended or adjusted under 35 U.S.C. 154(b) by 0 days.

(21) Appl. No.: 09/170,988

(22) Filed: Oct. 13, 1998

(51) Int. Cl.[7] ..... G10L 21/02; H04R 25/00

(52) U.S. Cl. ..... 704/221; 704/271; 381/56; 381/66; 379/406

(58) Field of Search ..... 704/221, 222, 704/271; 381/56, 103, 66, 23.1, 303, 312; 379/406, 411, 457

(56) References Cited

U.S. PATENT DOCUMENTS

| | | | | |
|---|---|---|---|---|
| 4,187,413 | | 2/1980 | Moser | 179/107 FP |
| 4,548,082 | | 10/1985 | Engebretson et al. | 73/585 |
| 4,731,850 | | 3/1988 | Levitt et al. | 381/68.2 |
| 4,852,175 | | 7/1989 | Kates | 381/68.1 |
| 4,879,738 | * | 11/1989 | Petro | 379/3 |
| 4,887,299 | | 12/1989 | Cummins et al. | 381/68.4 |
| 5,027,410 | | 6/1991 | Williamson et al. | 381/68.4 |
| 5,125,030 | | 6/1992 | Nomura et al. | 381/31 |
| 5,199,076 | | 3/1993 | Taniguchi et al. | 381/36 |
| 5,206,884 | | 4/1993 | Bhaskar | 375/34 |
| 5,251,263 | * | 10/1993 | Andrea et al. | 381/71 |
| 5,276,739 | | 1/1994 | Krokstad et al. | 381/68.2 |
| 5,323,486 | | 6/1994 | Taniguchi et al. | 704/222 |
| 5,608,803 | | 3/1997 | Magotra et al. | 381/68.2 |
| 5,737,389 | * | 4/1998 | Allen | 379/1 |
| 5,737,433 | * | 4/1998 | Gardner | 381/94.7 |
| 5,757,932 | | 5/1998 | Lindemann et al. | 381/68 |
| 5,852,769 | * | 12/1998 | Ahmed et al. | 455/115 |
| 6,011,853 | * | 1/2000 | Koski et al. | 381/56 |
| 6,018,706 | * | 1/2000 | Huang et al. | 704/207 |

OTHER PUBLICATIONS

Oticon, Hearing Aid History: Essential Highlights in the History of Hearing Instruments, Jun. 9, 1998, www. oticonus.com/HeaIns/HeaInsPg.htm.

HA Museum, The Kenneth W. Berger Hearing Aid Museum and Archives, Jun. 10, 1998, www.educ.kent.edu/elsa/berger.

Ongoing Odyssey from Patent to Market for Hearing Aid, Jun. 10, 1998, wupa.wustl.edu/record/archive/1997/12–04–97/5601.htm.

Mehr, Understanding Your Audiogram, Jun. 10, 1998, www.Audiology.com/consumer/understandaudio/uya.htm.

Oticon, What is Digital Technology: The Ultimate in Sound Processing, Jun. 9, 1998, www.oticonus.com/ProInf/DigFoc/WiDiTePg.htm.

SENSO—The Giant Leap in Technology, Jun. 9, 1998, www.widex.com/WebsMain.nsf/pages/SENSO+The+Giant+Leap+in=Technology.

PRISMA, Jun. 10, 1998, www.siemens–hearing.com/products/prisma/tech2info1.htm.

Mendelsohm, Now Hear This: Bionic–Ear Designers Deliver the Gift of Sound, Jun. 1998, Portable Design.

* cited by examiner

*Primary Examiner*—David R. Hudspeth
*Assistant Examiner*—Susan Wieland
(74) *Attorney, Agent, or Firm*—Fish & Richardson P.C.

(57) ABSTRACT

Methods and apparatus implementing a technique for producing an audio output customized to a listener's hearing impairment through a digital telephone. A user initially sets user parameters to represent the user's hearing spectrum. In receiving a call, the digital telephone receives an input signal. The digital telephone adjusts the input signal according to the user parameters and generates an output signal based upon the adjusted input signal.

19 Claims, 3 Drawing Sheets

CUSTOMIZING AUDIO OUTPUT TO A USER'S HEARING IN A DIGITAL TELEPHONE

TECHNICAL FIELD

The present disclosure relates to digital telephones, and more specifically to digital telephones with audio output that is customized to compensate for a user's individual hearing spectrum.

BACKGROUND

Conventional cellular phones provide an audio output which can be difficult to hear for a listener whose hearing is impaired. Increasing the output volume of the cellular phone is usually only partially effective when the listener's hearing is impaired. Typical hearing impairment occurs at select frequency bands. The hearing impairment may be complete or partial at any band. Uniform increasing of the output volume only addresses those bands which are partially impaired and so a uniform increase only partially aids the listener. In certain bands, which are completely impaired, the user still does not hear. The listener can also experience discomfort at the loudness of the output in bands which are not impaired in order to be able hear the other bands.

Conventional hearing aids typically provide selective amplification of sound to compensate for a user's specific hearing impairment.

Voice coder-decoders ("vocoders") have been used in cellular phones to achieve compression in the amount of digital information necessary to represent human speech. A vocoder in a transmitting device derives a vocal tract model in the form of a digital filter and encodes a digital sound signal using one or more "codebooks". Each codebook represents an excitation of the derived vocal tract filter in an area of speech. One typical codebook represents long-term excitations, such as pitch and voiced sounds. Another typical codebook represents short-term excitations, such as noise and unvoiced sounds. The vocoder generates a digital signal including vocal tract filter parameters and codebook excitations. The signal also includes information from which the codebooks can be reconstructed. In this way, the encoded signal is effectively compressed and hence uses less space than directly digitally representing every sound.

A receiving vocoder decodes a compressed digital signal using codebooks and the vocal tract filter. Based upon the parameters contained in the signal, the vocoder reconstructs the sound into an uncompressed digital sound. The digital signal is converted to an analog signal and output through a speaker.

SUMMARY

The present disclosure describes methods and apparatus implementing a technique for producing an audio output customized to a listener's hearing impairment through a digital telephone. A user initially sets user parameters to represent the user's hearing spectrum. In receiving a call, the digital telephone receives an input signal. The digital telephone adjusts the input signal according to the user parameters and generates an output signal based upon the adjusted input signal.

In a preferred implementation, a digital telephone includes a user parameter control element. The user parameter control element includes a memory for storing user parameters representing the user's hearing ability. The digital telephone receives a signal through a receiving element. A digital signal processor is connected to the user parameter control element and the receiving element. The digital signal processor includes a vocoder connected to the receiving element and a frequency transformation element. The digital signal processor shifts the signal from frequency bands in which the user parameters indicate the user's hearing is impaired to frequency bands in which the user parameters indicate the user's hearing is not impaired. The digital signal processor also amplifies the shifted signal in frequency bands in which the user parameters indicate the user's hearing is impaired. An output element connected to the digital signal processor outputs the amplified signal.

DETAILED DESCRIPTION

The present disclosure describes methods and apparatus for providing customized audio output from a digital telephone according to parameters set by a user. The preferred implementation is described below in the context of a cellular telephone. However, the technique is also applicable to audio output in other forms of digital telephony devices.

Figure 1:
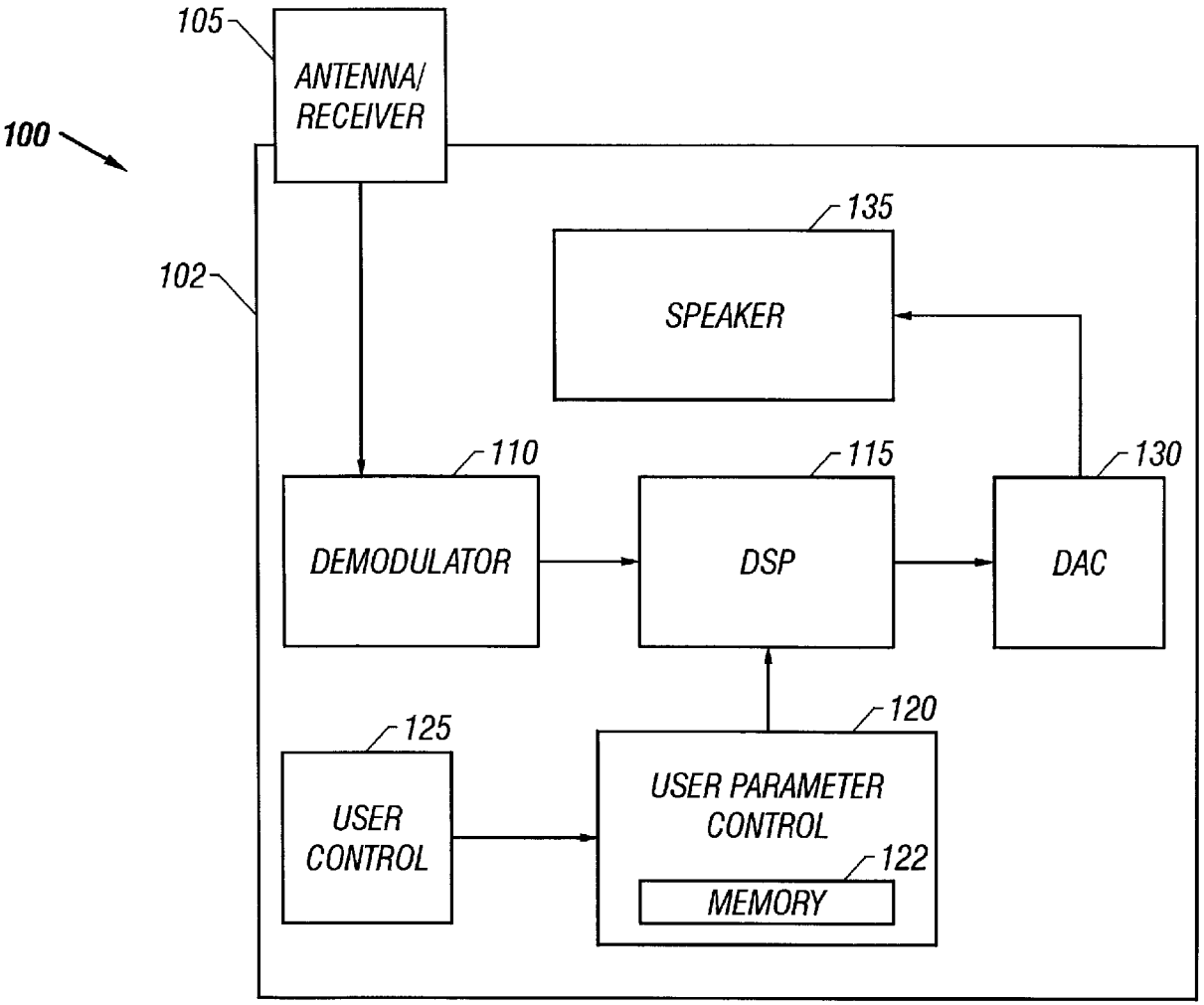
FIG. 1 is a block diagram of a digital telephone according to the present disclosure.

FIG. 1 shows a cellular phone 100. Cellular phone 100 is preferably an IS-95 cellular system. A case 102 forms a body of cellular phone 100 and includes the components described below. An antenna/receiver 105 receives an input analog signal. Antenna/receiver 105 is preferably a conventional type. A demodulator 110 converts the input analog signal to a digital signal. The digital signal is preferably a compressed digital signal from another phone via a central office. The output of demodulator 110 is supplied as a digital signal to a digital signal processor ("DSP") 115. DSP 115 processes the digital signal as is conventional in the art. Additional processing is done according to user parameters supplied by a user parameter control circuit 120. User parameter control circuit 120 includes a memory 122 to store the user parameters. In one implementation, memory 122 stores sets of user parameters for more than one user, possibly including pre-defined sets. The current user selects the appropriate set of user parameters, such as through a user control 125. DSP 115 uses the selected set of user parameters for processing, as described below.

A user control 125, such as a control on the exterior of cellular phone 100, provides user input to user parameter control circuit 120. A digital to analog converter ("DAC") 130 converts the adjusted digital signal to an output analog signal. A speaker 135 plays the analog signal such that the user hears the analog signal according to the user parameters. Cellular phone 100 also preferably includes an audio input or microphone (not shown) for receiving audio input, such as speech, from the user.

Figure 2:
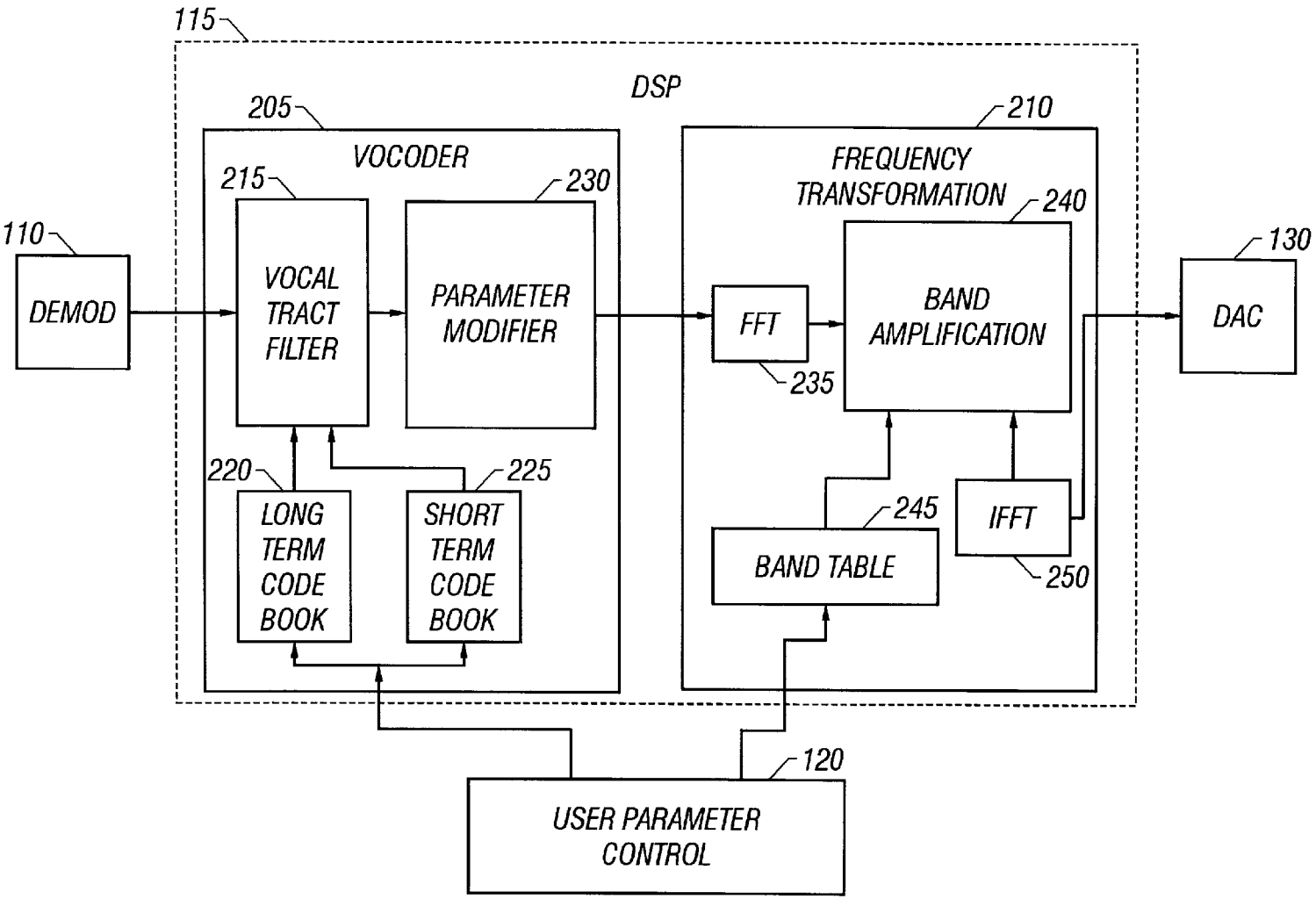
FIG. 2 is a block diagram of a digital signal processor.

FIG. 2 shows details of DSP 115. DSP 115 includes a vocoder 205 and a frequency transformation circuit 210. Vocoder 205 receives the digital signal from demodulator 110 and uncompresses the signal using a vocal tract filter 215. Vocoder 205 preferably includes a vocal tract filter 215 and, as conventional vocoders do, two codebooks, a long-term codebook 220 and a short-term codebook 225. Vocoder 205 uses long-term codebook 220 to decode long-term excitations, such as pitch and voiced sounds, encoded in the digital signal. Vocoder 205 uses short-term codebook 225 to decode short-term excitations, such as noise and unvoiced sounds, encoded in the digital signal. The codebook excitations are filtered by the vocal tract filter 215, which is defined by decoded parameters, to reproduce the decoded sound. In one implementation, the digital signal also includes information from which the codebooks of the source of the digital signal can be reconstructed. Vocoder 205 uses the reconstructed codebooks to facilitate the decoding process. Vocoder 205 also includes one or more filters 230 for transforming the encoded digital signal to a decoded and decompressed digital signal.

Vocoder 205 preferably includes an internal parameter modifier 230. Vocoder 205 configures internal parameter modifier 230 according to user parameters received from user parameter control circuit 120. Internal parameter modifier 230 has the effect of frequency shifting portions of the signal from frequency bands in which the user's hearing is impaired, into bands in which the user can hear or can hear better. Vocoder 205 configures parameter modifier 230 preferably by modifying the pitch lag parameter and/or by adjusting the poles and zeroes of the filter according to the user parameters. Details of the shifting technique are described below.

Frequency transformation circuit 210 adjusts the digital signal produced by vocoder 205 according to different frequency bands. A fast Fourier transform ("FFT") circuit 235 applies an FFT to the digital signal to convert the signal from the time domain to the frequency domain and divide the converted signal into a number of frequency bands. The number of bands affects the refinement of the adjustment to the signal and so a balance is established among refinement, performance, and cost according to the application. A band amplification circuit 240 selectively amplifies bands of the frequency divided signal.

Band amplification circuit 240 preferably amplifies the signal in those frequency bands in which the user's perception of sound is attenuated. Band amplification circuit 240 amplifies each band by an amount which brings the sound within the user's hearing range for that frequency band. A band table 245 receives user parameters from user parameter circuit 120 and supplies band parameters to band amplification circuit 240. The band parameters indicate which bands are to be amplified as well as the amount of appropriate amplification. The user parameters are set through an audio test, as described below. An inverse FFT ("IFFT") circuit 250 transforms the amplified signal from the frequency domain to the time domain, compiling the divided signal back into a unified digital signal. DAC 130 converts the digital signal to an analog signal to be output by cellular phone 100 through speaker 135.

Figure 3:
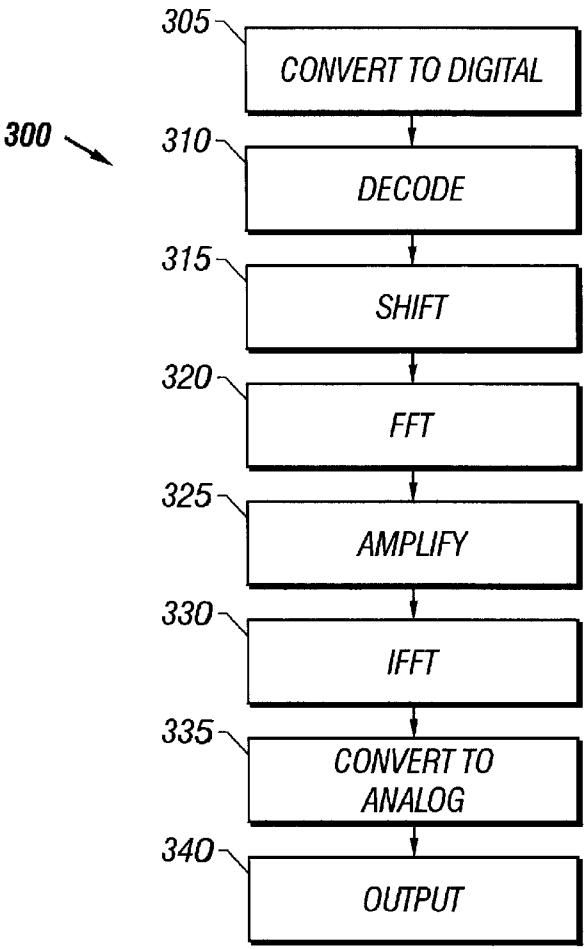
FIG. 3 is a flowchart of adjusting a signal.

Flowchart 300 shows the software or hardware of a preferred implementation, as shown in FIG. 3. Antenna/receiver 105 receives an analog signal and demodulator 110 converts the analog signal to a digital signal, step 305. DSP 115 adjusts the digital according to user parameters using vocoder 205 and frequency transformation circuit 210. The user parameters are set previously through an audio test, as described below. Vocoder 205 modifies parameters of the signal in order to shift portions of the decoded signal such that more of the signal is in frequency bands in which the user can hear, step 310, and decodes the digital signal. Frequency transformation circuit 210 transforms the signal into the frequency domain by applying an FFT, step 320. Frequency transformation circuit 210 amplifies portions of the transformed signal corresponding to frequency bands in which the user's hearing is attenuated, step 325. Frequency transformation circuit 210 returns the signal to the time domain by applying an inverse FFT, step 330. DAC 130 converts the adjusted digital signal to an analog signal, step 335, and the resulting analog signal is played through speaker 135, step 340.

In one implementation of modifying the long term codebook, the pitch lag parameter that determines the reconstructed form of the long term codebook, is adjusted so that portions of the underlying audio signal are mapped from frequency bands or regions where the user cannot hear to regions where the user can hear. Alternatively, regions where the user's hearing requires intolerably high levels of amplification are also mapped onto regions where the necessary amplification levels are more acceptable. In this case, the threshold level of intolerable amplification is based on the maximum amplitude signal of the cellular phone. The mapping preferably retains variation in pitch in order to allow for inflection in the voice while avoiding frequencies where the listener has very large or uncorrectable hearing loss as well as avoiding unnecessary jumps over frequency ranges. The technique involves comparing the measurement of the minimum energy $\gamma(i)$ required in a frequency band i that extends from $f(i-1)$ to $f(i)$ to the maximum allowable energy threshold $E_{max}(i)$ If $\gamma(i)$ exceeds $E_{max}(i)$, then the region is unacceptable and the frequencies from $f(i-1)$ to $f(i)$ are mapped into the nearest acceptable frequency range where the threshold is not exceeded.

The range of pitch lags supported by the vocoder determines the range of frequencies that are of interest. Typical values of pitch lags are $d_{min}$=16 samples and $d_{max}$=150 samples, which correspond to frequencies of 500 Hz and 53.3 Hz, respectively, for a signal sampled at 8 kHz. The overall frequency range is divided into m regions (not necessarily of equal size), referred to as region 1 through region m. No adjacent areas have the same characteristic with respect to acceptability, as described above, because the frequency defining the edge of the range can be increased or decreased to include the adjacent area.

Mapping an unacceptable region can be divided into five cases. In the first case, there is only one region covering the overall vocoder pitch range. In this case, there is no mapping to perform.

In the second case, there are only two regions (m=2). One region is unacceptable, e.g., the user cannot hear in the frequency band, and the other is acceptable, e.g., the user can hear in the frequency band. In this case, the entire frequency range from f(0) to f(2) is compressed into the region from f(0) to f(1) or from f(1) to f(2), depending on which region is acceptable. The mapping is preferably performed by linear compression. The compressed frequency $f_{new}$ is solved for in terms of the original frequency $f_{old}$ as follows $$f_{new} = [f_{old} - f(0)]\frac{f(2) - f(1)}{f(2) - f(0)} + f(1)$$

where region 1 is the unacceptable region, or $$f_{new} = [f_{old} - f(0)]\frac{f(1) - f(0)}{f(2) - f(0)} + f(0)$$

where region 2 is the unacceptable region.

In the third case, an unacceptable region is either region 1 or region m, and the adjacent acceptable region has another unacceptable region on the other side. The entire unacceptable region and half of the acceptable region are compressed into the half of the acceptable region adjacent to the unacceptable region. As above, fnew can be expressed as:

$$f_{new} = [f_{old} - f(0)]\frac{f_{mid}(1) - f(1)}{f_{mid}(1) - f(0)} + f(1)$$

where region 1 is the unacceptable region, or $$f_{new} = [f_{old} - f_{mid}(m-1)]\frac{f(m-1) - f_{mid}(m-1)}{f(m) - f_{mid}(m-1)} + f_{mid}(m-1)$$

where region m is the unacceptable region. The $f_{mid}$ frequency is a midpoint in the acceptable region. For example, for region i, $f_{mid}(i)=[f(i-1)+f(i)]/2$. Half the acceptable region is used because the other unacceptable region on the other side of the acceptable region is mapped onto the unused half of the acceptable region, as described below.

In the fourth case, the unacceptable region is region 2 or region "m−1". Half of the unacceptable region is mapped onto the adjacent acceptable region 1 or region m. Thus, half of the unacceptable region closest to the acceptable region 1 or m and the entire acceptable region 1 or m is mapped into the entire acceptable region 1 or m. The other half of the unacceptable region is mapped onto the acceptable region on the other side of the unacceptable region, as described below. As above, $f_{new}$ can be expressed as:

$$f_{new} = [f_{old} - f(0)]\frac{f(1) - f(0)}{f_{mid}(1) - f(0)} + f(0)$$

where region 2 is the unacceptable region, or $$f_{new} = [f_{old} - f_{mid}(m-1)]\frac{f(m) - f(m-1)}{f(m) - f_{mid}(m-1)} + f(m-1)$$

where region m−1 is the unacceptable region.

In the fifth case, the unacceptable region i is mapped onto an acceptable region that is not region 1 or region m. Half of the unacceptable region is mapped onto the half of the adjacent acceptable region which is adjacent to the unacceptable region. For example, the upper half of region i is mapped onto the lower half of region i+1 along with the lower half of region i+1. As above, $f_{new}$ can be expressed as:

$$f_{new} = [f_{old} - f_{mid}(i-1)]\frac{f(i-1) - f_{mid}(i-1)}{f(i) - f_{mid}(i-1)} + f_{mid}(i-1)$$

where unacceptable region i is mapped onto acceptable region i−1, or $$f_{new} = [f_{old} - f_{mid}(i)]\frac{f(i+1) - f(i)}{f(i+1) - f_{mid}(i)} + f(i)$$

where unacceptable region i is mapped onto acceptable region i+1.

Figure 4:
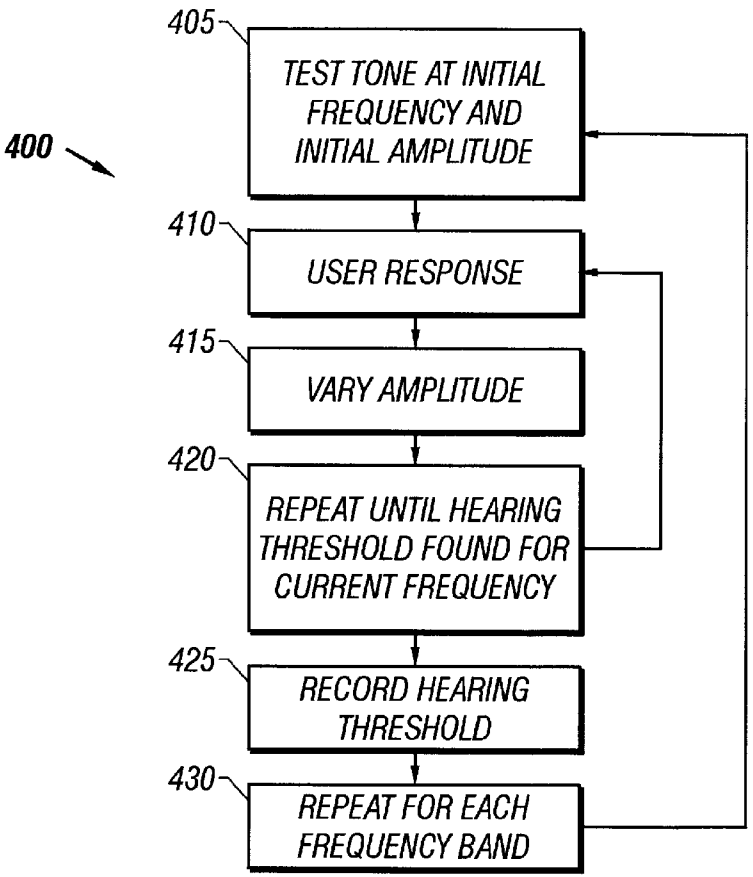
FIG. 4 is a flowchart of setting user parameters.

The user sets the user parameters in an audio test by responding to a series of tones produced by the cellular phone. As shown in FIG. 4, in a process 400 of setting the user parameters, cellular phone 100 generates an initial test tone played through speaker 135, step 405. This initial test tone is at a first amplitude and frequency, preferably at an amplitude which can be heard by a person with average hearing and at a frequency corresponding to the lowest of the frequency bands used in DSP 115. The user indicates if the user can hear the initial test tone, such as by pressing a button in user control 125, step 410. If the user can hear the initial test tone, cellular phone 100 generates another test tone at the same frequency but at a lower amplitude, step 415. Cellular phone 100 continues to generate test tones at successively lower amplitudes until the user does not indicate the user can hear the test tone or some minimum threshold has been reached, step 420. This final test tone marks the hearing threshold of the user for the current frequency.

If the user does not indicate the user can hear the initial test tone, such as by taking no action, step 410, cellular phone 100 generates a test tone at the same frequency but at a higher amplitude, step 415. Cellular phone 100 continues to generate test tones at successively higher amplitudes until the user indicates the user can hear the test tone or some maximum threshold has been reached, step 420. This final test tone marks the hearing threshold of the user for the current frequency.

User parameter control circuit 120 records the amplitude and frequency of the user's hearing threshold for the current frequency in memory 122, step 425. Cellular phone 100 repeats steps 405 through 425 for each frequency band, step 430. After user parameter control circuit 120 has recorded a hearing threshold for each frequency, user parameter control circuit has a table of user parameters modeling the user's hearing ability. As noted above, the number of frequency bands used corresponds to the number of frequency bands or regions discussed above in the operation of vocoder 205 and frequency transformation circuit 210.

In an alternative implementation, the digital signal processor described above is included in a digital telephone in a conventional telephone network. An analog signal received at the digital telephone is converted to a digital signal and adjusted as described above. Alternatively, the digital telephone can be a combined software and hardware implementation in a computer system.

In another alternative implementation, the components of the cellular phone described above interact with a hearing aid device. In this case, the cellular phone transmits the adjusted signal to the hearing aid device which in turn plays the audio signal through its own speaker.

The components of the digital signal processor described above can be implemented in hardware or programmable hardware. Alternatively, the DSP can include a processing unit using software which can be accessed through a port or card connection.

Numerous implementations have been described. Additional variations are possible. For example, the signal received by the telephone can be a digital signal supplied over a digital network. The user parameters can be obtained by downloading values to the telephone rather than through manual entry by a user. Accordingly, the technique of the present disclosure is not limited by the exemplary implementations described above, but only by the scope of the following claims.

What is claimed is:

1. A method of adjusting audio output of a digital telephone, comprising:

obtaining user parameters which represent a user's individual hearing spectrum, wherein obtaining the user parameters comprises generating a plurality of tones with the digital telephone, receiving a user response to a plurality of said tones entered into the digital telephone, and setting a user parameter based upon the user responses;

receiving a digital input signal representing information to be heard by the user;

adjusting the digital input signal according to the user parameters to form a hearing-adjusted digital signal; and generating an analog output signal based upon the hearing-adjusted digital signal.

2. The method of claim 1, wherein setting the user parameters comprises:

repeatedly generating a test tone at a frequency with varying amplitude according to user responses until a hearing threshold is determined for the frequency; and setting a user parameter based upon the hearing threshold.

3. The method of claim 1, wherein the user parameters divide an audio spectrum into a plurality of bands and indicate the user's ability to hear for each band.

4. The method of claim 3, wherein adjusting the digital input signal comprises:

amplifying the digital input signal in frequency bands in which the user parameters indicate the user's hearing is impaired.

5. The method of claim 3, wherein adjusting the digital input signal comprises:

digitally shifting the pitch lag parameter of the digital input signal from frequency bands in which the user parameters indicate the user's hearing is impaired to frequency bands in which the user parameters indicate the user's hearing is less impaired.

6. The method of claim 5, further comprising:

using a vocoder to process the digital input signal, wherein the shifting of the digital input signal comprises shifting poles and zeroes of a vocal tract filter function in the vocoder.

7. A method of adjusting audio output of a digital telephone, comprising:

obtaining user parameters which represent a user's individual hearing spectrum, wherein obtaining the user parameters comprises generating a plurality of tones with the digital telephone, receiving a user response to a plurality of said tones entered into the digital telephone, and setting a user parameter based upon the user responses;

receiving a digital signal;

decoding the received digital signal using a vocoder;

using the vocoder to shift the pitch lag parameter of the decoded digital signal from frequency bands in which the user parameters indicate the user cannot hear to frequency bands in which the user parameters indicate the user can hear, in addition to using the vocoder to shift the poles and zeros of the vocal tract filter function in the vocoder, forming a shifted digital signal; and generating an analog output signal based upon the digital signal.

8. The method of claim 7, further comprising:

applying a fast Fourier transform to the shifted digital signal to convert the shifted digital signal from a time domain into a frequency domain;

amplifying the converted digital signal in frequency bands in which the user parameters indicate the user's hearing is impaired; and applying an inverse fast Fourier transform to the amplified digital signal to convert the amplified digital signal from the frequency domain into the time domain.

9. A method of adjusting audio output of a digital telephone, comprising:

obtaining user parameters which represent a user's individual hearing spectrum, wherein obtaining the user parameters comprises generating a plurality of tones with the digital telephone, receiving a user response to a plurality of said tones entered into the digital telephone, and setting a user parameter based upon the user responses;

receiving a digital signal;

decoding the received digital signal using a vocoder;

applying a fast Fourier transform to the digital signal to convert the digital signal from a time domain into a frequency domain;

amplifying the converted digital signal in frequency bands in which the user parameters indicate the user's hearing is impaired;

applying an inverse fast Fourier transform to the amplified digital signal to convert the amplified digital signal from the frequency domain into the time domain; and generating an analog output signal based upon the digital signal.

10. The method of claim 9, further comprising:

using the vocoder to shift the digital signal from frequency bands in which the user parameters indicate the user cannot hear to frequency bands in which the user parameters indicate the user can hear by shifting poles and zeroes of a filter function in the vocoder.

11. A method of adjusting audio output of a digital telephone to match a user's individual hearing ability, comprising:

first, adjusting a received digital signal according to a first set of user parameters which represent a first user's hearing ability; and second, adjusting a received digital signal according to a second set of user parameters which represent a second user's hearing ability.

12. A digital telephone for adjusting audio output to a user's individual hearing spectrum, comprising:

an audio output;

an audio input;

an entry for receiving a digital signal;

a case coupled to the audio output, the audio input, and the entry;

a memory for storing user parameters which represent the user's individual hearing ability; and a digital signal processor coupled to the memory, the entry, and the audio output, wherein the digital signal processor includes a vocoder connected to the entry and a frequency transformation element, and wherein the digital signal processor shifts the signal from frequency bands in which the user parameters stored in the memory indicate the user's hearing is impaired to frequency bands in which the user parameters indicate the user's hearing is not impaired, and wherein the digital signal processor amplifies the shifted signal in frequency bands in which the user parameters stored in the memory indicate the user's hearing is impaired.

13. The digital telephone of claim 12, wherein adjusting the digital signal comprises:

amplifying the digital signal in frequency bands in which the user parameters indicate the user's hearing is impaired.

14. The digital telephone of claim 12, wherein adjusting the digital signal comprises:

shifting the digital signal from frequency bands in which the user parameters indicate the user's hearing is impaired to frequency bands in which the user parameters indicate the user's hearing is less impaired.

15. A digital telephone for adjusting a digital signal according to a user's hearing ability, comprising:

a user parameter control element including a memory for storing user parameters representing the user's hearing ability;

a receiving element for receiving a signal;

a digital signal processor connected to the user parameter control element and the receiving element, where the digital signal processor includes a vocoder connected to the receiving element and a frequency transformation element, and where the digital signal processor shifts the signal from frequency bands in which the user parameters stored in the memory indicate the user's hearing is impaired to frequency bands in which the user parameters indicate the user's hearing is not impaired, and where the digital signal processor amplifies the shifted signal in frequency bands in which the user parameters stored in the memory indicate the user's hearing is impaired; and an output element connected to the digital signal processor, for outputting the amplified signal.

16. The digital telephone of claim 15, where the frequency transformation element includes at least one amplifier.

17. The digital telephone of claim 15, where the vocoder shifts the signal.

18. The digital telephone of claim 15, where the frequency transformation element amplifies the shifted signal.

19. The digital telephone of claim 15, where the vocoder includes a long-term codebook and a short-term codebook.

* * * * *